United States Patent [19]

Teraura et al.

[11] Patent Number: 4,531,921

[45] Date of Patent: Jul. 30, 1985

[54] STEERING SYSTEM FOR A BOAT

[75] Inventors: Makoto Teraura; Masanao Baba, both of Takarazuka, Japan

[73] Assignee: Nippon Cable System, Inc., Hyogo, Japan

[21] Appl. No.: 574,770

[22] Filed: Jan. 27, 1984

[30] Foreign Application Priority Data

Jul. 25, 1983 [JP] Japan ..... 58-136355

[51] Int. Cl.[3] ..... B63H 25/02

[52] U.S. Cl. ..... 440/53; 440/60; 114/154; 114/144 R

[58] Field of Search ..... 74/422, 89.17, 498, 74/480 B, 484, 501 R; 114/144 R, 156, 159; 440/53, 58, 60; 180/145

[56] References Cited

U.S. PATENT DOCUMENTS 3,110,193 11/1963 Bratz ..... 74/480 B
3,118,321 1/1964 Rinke ..... 114/144 R
3,208,300 9/1965 Morse ..... 114/144 R
4,095,482 6/1978 Kirschner ..... 74/422
4,133,222 1/1979 Dooley ..... 74/422

*Primary Examiner*—Trygve M. Blix
*Assistant Examiner*—Edwin L. Swinehart
*Attorney, Agent, or Firm*—Armstrong, Nikaido, Marmelstein & Kubovcik

[57] ABSTRACT

A steering system for a boat, comprising a steering unit, at least one push-pull control cable and a pinion-rack unit. The pinion-rack unit has a rack casing having at least one inner cable guiding portion along at least one side wall thereof, a cable guide for outwardly guiding smoothly an inner cable of the push-pull control cable from the inner cable guiding portion, an end portion of the inner cable connected with the end portion of the rack, and a pinion meshed with the rack. The steering system can be easily mounted on a boat, does not require a wide space for mounting and for arranging a push-pull control cable, and can be applied to several types of boats, e.g. a boat which has two or more operator's seats.

9 Claims, 7 Drawing Figures

STEERING SYSTEM FOR A BOAT

BACKGROUND OF THE INVENTION

The present invention relates to a novel steering system for a boat, and more particularly to a steering system for remotely controlling a rudder means through a push-pull control cable by means of a rotational operation of a steering wheel provided at an operator's seat of a boat.

Hitherto, a mechanism disclosed in the U.S. Pat. No. 3,208,300, as an example, has been known as a steering system mentioned above. As shown in FIG. 7, the conventional steering mechanism has a pinion 52 fixed to a steering shaft 51, a rack 53 being meshed with the pinion 52, an inner cable 54 of a push-pull control cable having an end portion connected with the rack 53, a rack cartridge 55 containing and guiding slidably the rack 53, and the like. Thereby, a rotational operation of a steering wheel is changed into a sliding linear motion of the inner cable 54, and a rudder means is operated.

In such a kind of steering system, since the inner cable 54 acts in the pushing direction, it is necessary to guide the inner cable 54 extending from an outer casing 57 in order to protect the inner cable 54 from buckling during the whole reciprocating stroke of the inner cable 54. Therefore, in the conventional steering system shown in FIG. 7, a rod 58 which is longer than the reciprocating stroke is connected to the end of the inner cable 54. Further, a guide pipe 59 is provided in the rack cartridge 55 or a rack casing in order to guide the inner cable 54 which comes out of the outer casing 57. That is to say, many members, e.g. the rod 58, the guide pipe 59, and the like, are employed in the conventional steering system. Further, there is a disadvantage that the construction is very complex and frictional resistance is high, since the rod 58, the guide pipe 59, the rack 53 and the rack cartridge 55 are telescopically inserted within each other. Also, the conventional system has another disadvantage that the width of the system is very wide, since a member 60 for fixing the outer casing 57 of the control cable is fastened to one end of the rack cartridge 55. Therefore, a wide space is required in the conventional system. Also, when the push-pull control cable is arranged in a narrow space of a boat, the sliding frictional resistance in the control cable becomes large, since a radius of curvature of a curved portion of the push-pull control cable becomes small.

OBJECT OF THE INVENTION

A main object of the present invention is to provide a steering system for a boat which does not require a wide space for mounting, especially in width.

Another object of the present invention is to provide a steering system in which a push-pull control cable extending from a driving unit of the system can be arranged in a large radius of curvature.

Another object of the invention is to provide a steering system in which an inner cable is smoothly guided outwardly from a center portion or the neighborhood thereof of the rack casing.

Another object of the invention is to provide a steering system having a wide use and by which multiple push-pull control cables can be operated.

Other objects and advantages of the invention will become apparent from the following description with reference to the accompanying drawings.

DETAILED EXPLANATION OF THE INVENTION

Figure 1:
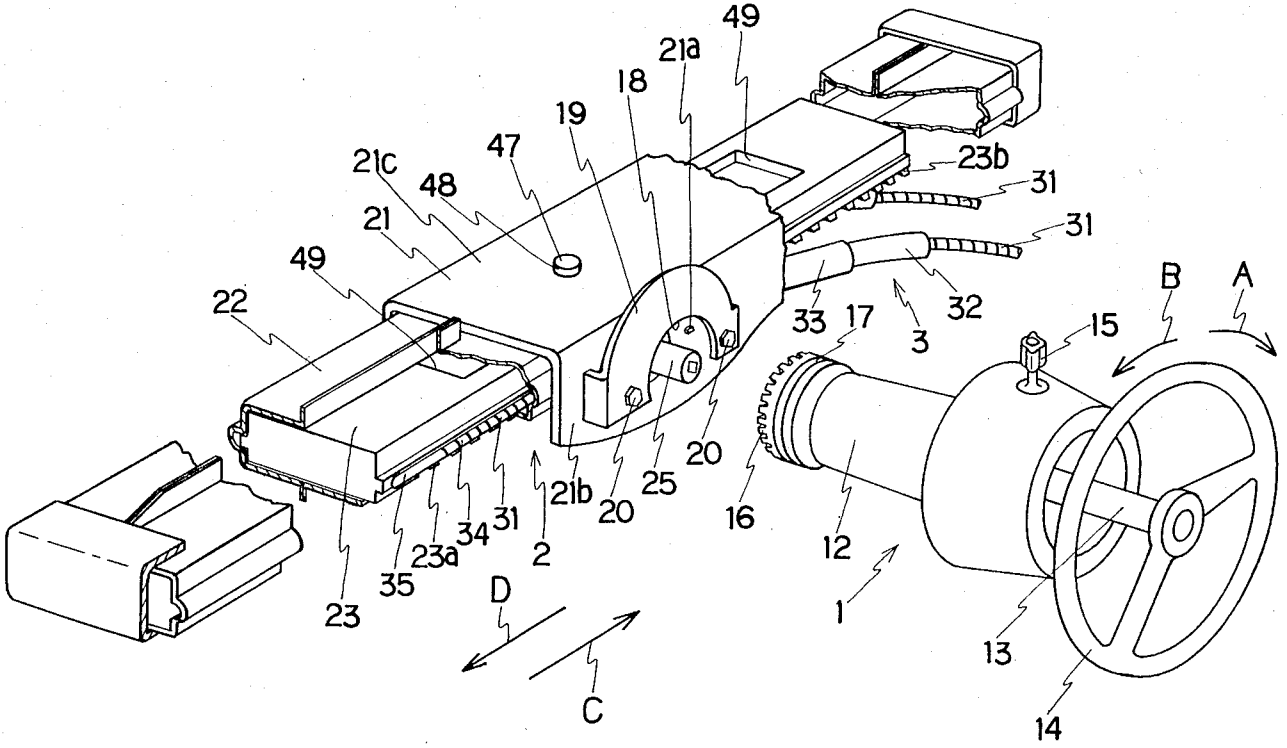
FIG. 1 is a partially cutaway perspective view showing an embodiment of a steering system of the present invention.

A steering system of the present invention has three structural parts, i.e. a steering unit 1, a pinion-rack unit 2 and at least one push-pull control cable 3, as shown in FIG. 1.

Figure 2:
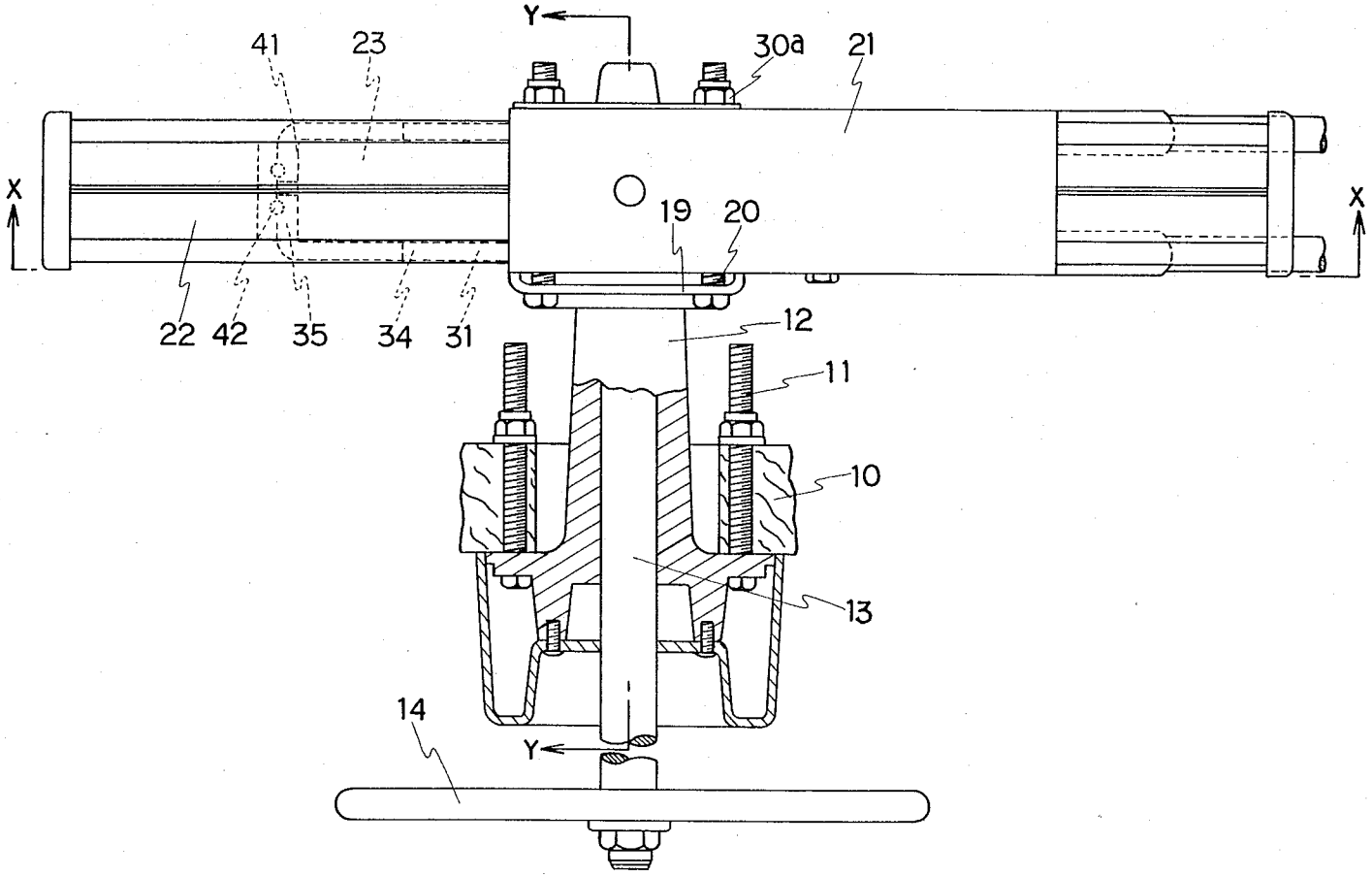
FIG. 2 is a partially cutaway bottom view showing the embodiment of the steering system of the invention shown in FIG. 1.

As shown in FIG. 2 in detail, the steering unit 1 possesses a housing 12 mounted on a dashboard 10 (see FIG. 6) of an operator's seat of a boat by means of bolts 11, or the like. A steering shaft 13 is rotatably inserted into the housing 12. A steering wheel 14 is fixed to an end portion of the steering shaft 13.

Figure 4:
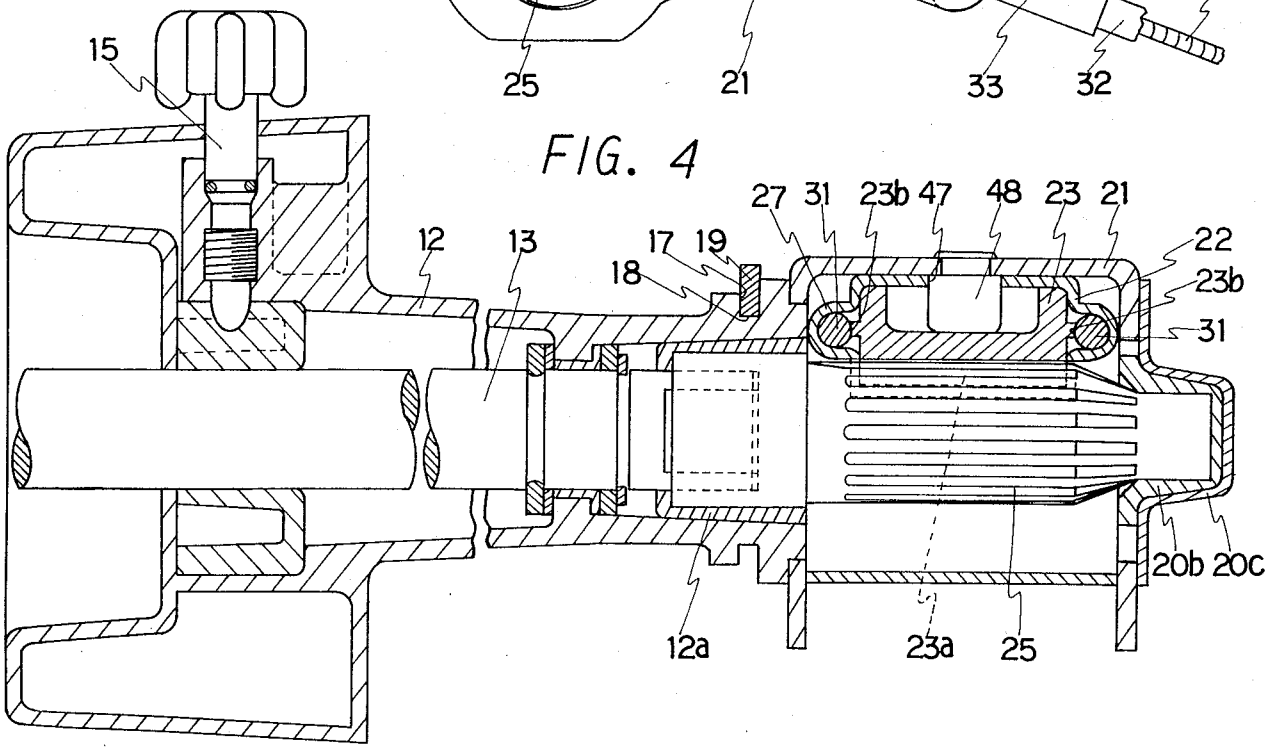
FIG. 4 is a sectional view on line Y—Y of FIG. 2.

As shown in FIG. 4, a braking means 15 for adjusting a rotational resistance of the steering shaft 13 is provided on the housing 12. A set of circularly-arranged teeth 16 is formed at a top end portion of the housing 12. The set of teeth 16 engages with several projections **21*a* formed on a bracket 21. Further, an annular groove 17 is formed around the outer surface proximate the top end portion of the housing 12**.

The pinion-rack unit 2 possesses, as shown in FIGS. 1 to 4, a bracket 21. The bracket 21 is formed by bending up both side portions of a metal plate. That is to say, the bracket 21 has a bottom plate **21*c* and two side walls 21*b* and has C-shaped form in section. A rack casing 22 having a flat-tubular-form is inserted inside of the bracket 21. A rack 23 is slidably inserted into the rack casing 22. Further the pinion-rack unit 2 possesses a pinion 25 being meshed with the rack 23 and a cable guide 26 for guiding an inner cable 31 of a push-pull control cable 3. The rack 23 is arranged so that a teeth surface side 23*a* turns down. An opening 24 is formed at the center portion or its proximaty of the rack casing 22. The teeth surface side 23*a* faces the opening 24. The pinion 25, being meshed with the rack 23, is provided at the opening 24. The bracket 21 and the housing 12 are combined by a means for combining, e.g. a U-shaped lock plate 19, bolts 20, and the like, as mentioned later, and the pinion 25 is rotatably supported with an end portion of the housing 12 and a bushing 12*a* in the housing 12. The pinion 25 is securely connected with the steering shaft 13**.

Figure 5:
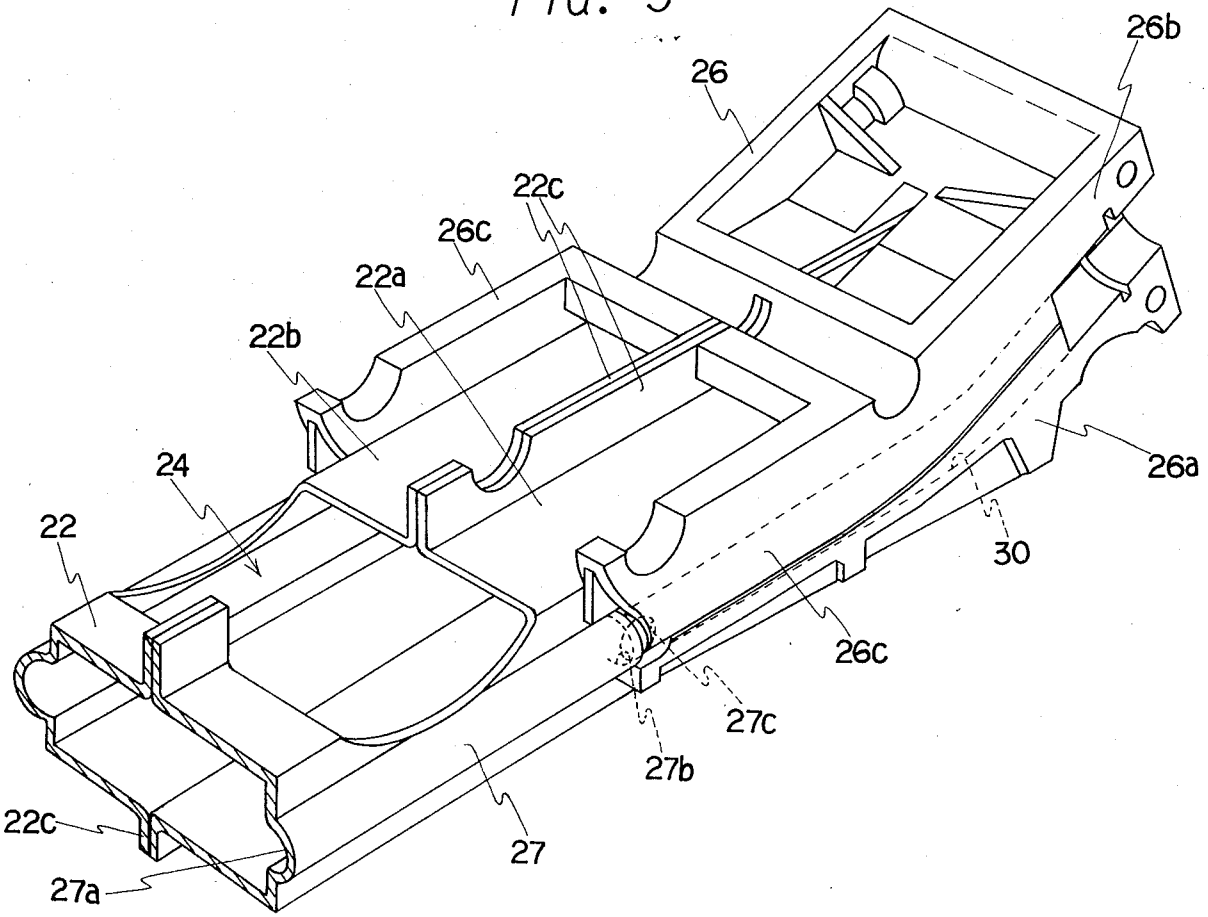
FIG. 5 is a segmentary perspective view from back side showing an embodiment of a combined state of a cable guide and a rack casing in a steering system of the invention.

As shown in FIG. 4 and FIG. 5 in detail, inner cable guiding portions 27 are formed along side walls of the rack casing 22. The inner cable guiding portions 27 having guiding surfaces **27*a* having semicircle-shaped forms in section for slidably guiding the inner cables 31. In the embodiment of the invention shown in FIG. 5, a rack casing 22 is manufactured by welding ribs 22*c*** of two halves 22*a*, 22*b*. These two halves 22*a*, 22*b* are respectively formed by stamping metal plates. Each center portion of the inner cable guiding portions 27 is cut, and small openings 27*b* open in an axial direction.

A cable guide 26 is arranged at a teeth surface side of the rack casing 22. Two front portions 26*c* of the cable guide 26 extend along both side surfaces of the rack casing 22 and the front end portions of the cable guide are jointed to the above small openings 27*b*. The side surfaces of the rack casing 22 along the front portions 26*c* are flattened. The cable guide 26 is provided with guide grooves 30 being continued to the guiding surfaces 27*a* at the positions of the small openings 27*b*. The guide grooves 30 guide slidably inner cables 31 coming out of the small openings 27*b* to the rear end portion of the cable guide 26.

In the embodiment of the present invention shown in FIGS. 1 to 5, the cable guide 26 is divided into two pieces 26*a*, 26*b* along the guide grooves 30. Therefore, the inner cables 31 can be easily inserted into the guide grooves 30.

Each push-pull control cable 3 has the same constitution as a conventional known push-pull control cable. That is to say, the push-pull control cable 3 comprises a flexible inner cable 31 for transmitting a tensile force and a compressive force in the axial direction and a flexible outer casing 32 for guiding slidably the inner cable 31. An end portion of the outer casing 32 is engaged with the rear end portion of the cable guide 26 by means of a fitting member 33, and the other end of the outer casing 32 is engaged to a rudder means, e.g. a rudder 61 in FIG. 6. As shown in FIG. 2, a L-shaped end fitting 35 is securely caulked at an end 34 of the inner cable 31. The end fitting 35 is inserted into a lateral groove 41 extending from the side surface toward the center portion of the rack 23 and is fixed to a front portion of the rack 23 by means of a screw 42, or the like. The opposite end of the inner cable 31 is engaged to an operable member 62, e.g. a connecting rod of the rudder means 61 mentioned above.

The inner cable 31 is guided out of the small opening 27*b* through a path between the side surface of the rack 23 and the guiding surface 27*a* of the inner cable guiding portion 27. Further the inner cable coming out of the small opening 27*b* turns smoothly along the guide groove 30 of the cable guide 26 and is guided to the outer casing 32.

Hereinafter, an operation of a steering system of the invention constructed as mentioned above is described.

As shown in FIG. 1, when the steering wheel 14 is operated to rotate in the direction of an arrow A or B, the pinion 25 is rotated in the same direction. Accompanying the rotational motion of the pinion 25, the rack 23 takes a linear motion in the direction of an arrow C or D. Therefore, the inner cable 31 having an end 34 engaged with an end of the rack 23 is pushed or pulled by the rack 23 and takes a linear motion. The inner cable 31 is slidably guided and turns smoothly in the slant direction along the cable guide 26. Further, the inner cable 31 goes out of the center portion or its proximity of the rack casing 22. The inner cable 31 advances through the outer casing 32 and drives the rudder means 61 to swivel.

In the embodiment of the invention shown in FIG. 1, longitudinally extending projecting portions 23*b* are provided at both side surfaces of the rack 23, as shown in FIG. 4 in detail. The projecting portions 23*b* have the same thickness as that of the plate member constituting the rack casing 22. Thereby, there is no difference in level between the guide groove 30 of the front portion 26*c* of the cable guide 26 and the surface of the projection 23*b*. Therefore, guidance of the inner cable 31 from the inside of the rack casing 22 to the cable guide 26 is smoothly transferred.

As shown in FIG. 5, a cut portion 27*c* capable of inserting the bent portion of the L-shaped end fitting 35 is perforated at an adjacent position near the small opening 27*b* through the flat side wall of the rack casing 22. Therefore, the end fitting 35 can be easily attached to the rack 23 by adjusting the position of the lateral groove 41 to face the cut portion 27*c*, inserting the bent portion of the end fitting 35 and fastening a screw 42 through the opening 24 of the teeth surface side of the rack casing 22.

As shown in FIG. 4, when a hole 47 is perforated at a rear surface side of the rack casing 22 in a proper position and a projection 48 capable of being inserted into the hole is fixed to the bracket 21, the blacket 21 can be easily mounted in the correct position relative to the rack casing 22. Further, when the hole 47 is faced on a position in which the pinion 25 is provided and the rear side surface of the rack 23 is pushed by the top surface of the projection 48, a backlash between the rack 23 and the pinion 25 can be kept in a suitable amount. Further, when the projection 48 is constructed so that the projecting height is adjustable by means of an adjusting means, e.g. a screw means, the backlash can be suitably and easily adjusted in accordance with each steering system.

When stoppers 49, as shown in FIG. 1, which can engage with the projection 48 are provided near the both end portions of the rear side of the rack 23, a slide stroke of the rack 23 can be easily and surely limited.

As shown in FIG. 2, a steering system of the invention has a steering unit 1 mounted on the front side of the dashboard 10, a pinion-rack unit 2 arranged behind the dashboard 10 and a control cable 3. Therefore, the steering unit 1 and the pinion-rack unit 2 are divided, and means for easily combining the housing 12 and the bracket 21 is employed. An example of the means for combining is shown in FIG. 1 and FIG. 2. An annular groove 17 is formed proximate the top end of the housing 12. An inner surface 18 of a U-shaped lock plate 19 is inserted into the annular groove 17. At least two bolts 20 are inserted into bolt holes perforated through both end portions of the lock plate 19 and are connected to the side surface of the bracket 21. The bolts 20 have long screw portions. That is to say, when the means for combining is constructed as mentioned above, the pinion-rack unit 2 can be supported with the housing 12 by merely hanging the inner surface 18 of the lock plate 19 on the annular groove 17 proximate the top end of the housing 12. In the above situation, the pinion-rack unit 2 can be swivelled around the housing 12. Accordingly, by swivelling the pinion-rack unit 2 to a suitable angle, for example, to the horizontal or to an inclined state in a certain angle out of the horizontal, engaging the set of circularly arranged teeth 16 to the projections 21*a* of the bracket 21, attaching the pinion-bearing 20*b* and the cover 20*c* to the bolts 20, and tightening nuts 30*a* around the bolts 20, the pinion-rack unit 2 can be easily combined to the housing 12. Then, there is no necessity to support the weight of the pinion-rack unit 2 by hand, or the like during the combining work.

In a steering system of the invention, since the push-pull control cable 3 extends slantingly from the center portion or its proximity of the pinion-rack unit 2, the width of the steering system can be reduced and the push-pull control cable can be arranged in a large radius of curvature. Therefore, the space for arranging the push-pull control cable can be remarkably reduced.

Figure 3:
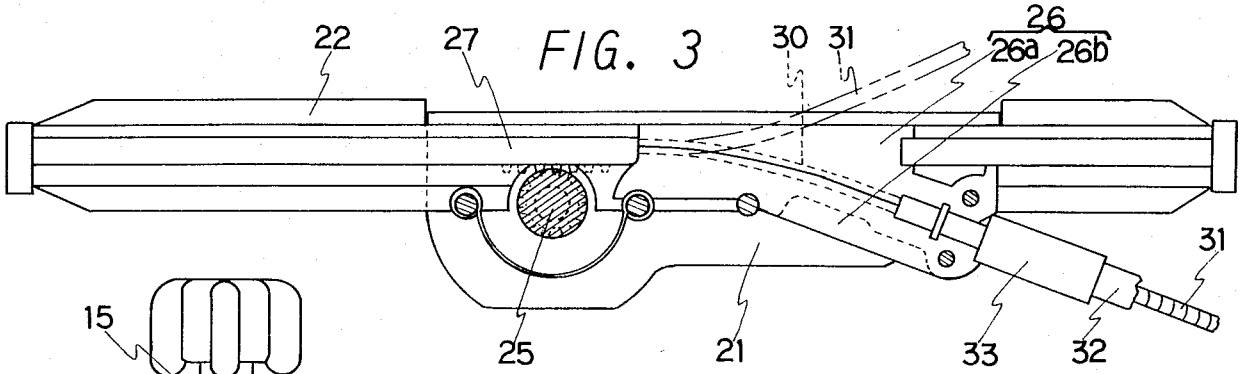
FIG. 3 is a sectional view on line X—X of FIG. 2.

In a steering system for a boat of the present invention, an inner cable 31 is arranged along a side surface of a rack 23. Therefore, it is easy to guide outwardly the inner cable 31 coming out of a small opening 27*b* toward a teeth surface side as shown in FIG. 3 or toward a rear surface side as shown by two dot chain lines in FIG. 3. Also, when a cable guide 26 is constructed so that it can be attached to a desired one of the teeth surface side or rear surface side, the guiding direction of the inner cable 31 can be optionally selected according to the kind of the boat, cable arranging method, or the like.

Figure 6:
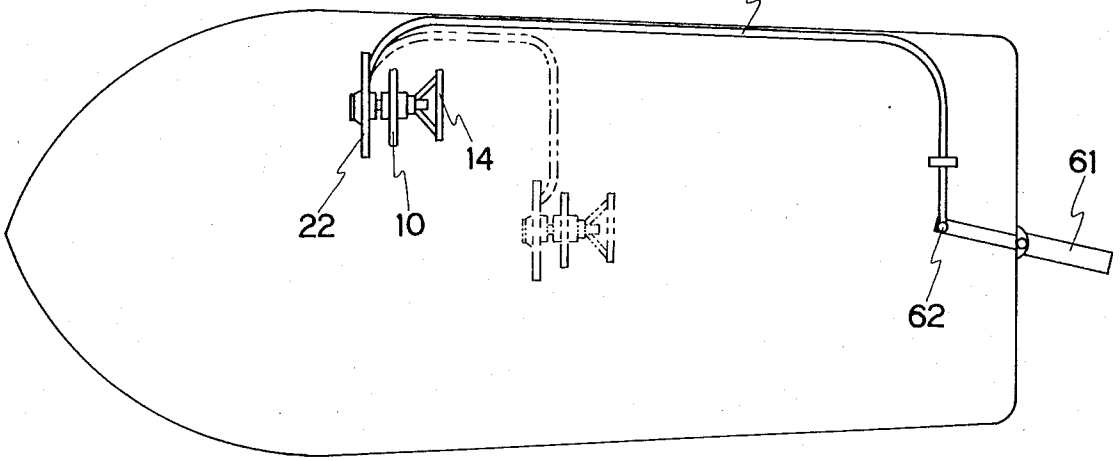
FIG. 6 is a schematic plan view of an example of a boat employing a steering system of the invention.
Figure 7:
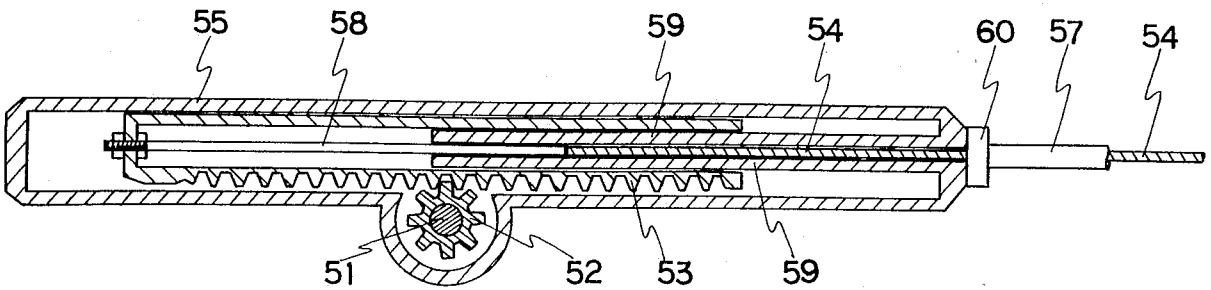
FIG. 7 (PRIOR ART)
FIG. 7 is a longitudinal sectional view showing an example of a conventional steering system for a boat.

Further, a steering system for a boat of the present invention can be easily applied to a boat in which two or more operator's seats are provided and each operator's seat has a steering system, so that the boat can be operated from a desired one of the operator's seats, as shown in FIG. 6. That is to say, as shown in FIGS. 1 to 5, when two inner cable guiding portions 27 are provided at both sides of the rack casing 22 and two guide grooves 30 jointed to the two inner cable guiding portions 27 are formed in the cable guide 26, two inner cables 31 can be driven by one rack 23. Of course, only one push-pull control cable may be employed in a boat in which two or more operator's seats are provided.

As described above, a steering system for a boat of the present invention has many advantages such that the mounting space for a pinion-rack unit and a push-pull control cable is reduced, and an inner cable can be smoothly guided out of a rack to a cable guide.

Though, in the above explanations and drawings, some preferred embodiments of a steering system of the present invention are described, various changes and modifications may be made in the invention without departing from the spirit and the scope thereof.

What is claimed is:

1. A rack-and-pinion steering system for controlling at least one push-pull rudder control cable of a boat, comprising:

(a) a longitudinally extending flat tubular rack casing provided with a large opening proximate a central lower portion thereof;

(b) at least one inner cable guiding portion formed along at least one side wall of said rack casing, said inner cable guiding portion extending in the longitudinal direction of said rack casing and having a small opening provided in said rack casing side wall proximate a central portion thereof and facing said longitudinal direction;

(c) a rack slidably carried in said rack casing;

(d) a pinion disposed at said large opening of said rack casing, said pinion being meshedly engaged with said rack such that rotation of said pinion causes said rack to move longitudinally;

(e) at least one inner cable of a push-pull control cable, one end of said inner cable being engaged with an end of said rack, with a front portion of said inner cable extending from said end being carried between said inner cable guiding portion and a side surface of said rack, a continuing portion of said inner cable extending through said small opening of said rack casing, and the other end of said inner cable being connected with a rudder means or another steering system of the boat;

(f) a rigid cable guide having at least one front end portion thereof jointed to said small opening of said rack casing and having at least one guide groove extending from said front end portion to a rear end portion of said rigid cable guide, said rigid cable guide and its guide groove being smoothly curved between said front and rear end portions for slidably guiding said inner cable in a slanting direction with respect to said longitudinal direction of said inner cable guiding portion of said rack casing, a front end of said guide groove being co-axial with said small opening of said rack casing and said rigid cable guide being attachable to said rack casing;

(g) at least one outer casing of said push-pull control cable for slidably guiding said inner cable to said rudder means or to said other steering system, one end of said outer casing being connected to said rear end portion of said cable guide with an end portion of said outer casing proximate said end extending along a direction of said rear end of said guide groove;

(h) a bracket for attaching said cable guide to said rack casing;

(i) a steering shaft having one end portion securely connected with said pinion, a steering wheel being securely attached to the other end portion of said steering shaft;

(j) a housing rotatably supporting said steering shaft; and (k) joining means for joining said attached rack casing and cable guide with said housing.

2. A steering system for a boat according to claim 1, wherein said rigid cable guide is constructed so that said rigid cable guide can be attached at either of the respective upper or lower surfaces of said rack casing.

3. A steering system for a boat according to claim 1, wherein said rack casing is provided with a projection at an inside surface of a rear side of said rack casing, said projection being directed towards said pinion, and a top surface of said projection contacts slidably with a rear side surface of said rack.

4. A steering system for a boat according to claim 3, wherein said rack is provided with two stoppers at said rear side surface thereof, whereby said stoppers restrict a reciprocating sliding linear motion of said rack by engaging with said projection.

5. A steering system for a boat according to claim 1, wherein said joining means comprises:

an annular groove formed proximate the top end of said housing;

a U-shaped lock plate having an inner surface and rotatably inserted into said annular groove; said lock plate having at least two bolt holes; and at least two bolts being connected to said bracket through said bolt holes.

6. A steering system for a boat according to claim 1, wherein a lateral groove is formed at an end portion of said rack, said lateral groove extending from a side surface toward a center portion of said rack, and an L-shaped end fitting is securely fixed at said end portion of said inner cable, said end fitting being engaged with said lateral groove.

7. A steering system according to claim 1, wherein said rack casing is provided with two inner cable guiding portions at respective side walls thereof, and said rigid cable guide is provided with two front end portions and two guide grooves, each said guide groove extending to each said inner cable guiding portion.

8. A steering system according to claim 1, wherein said at least one rigid cable guide is smoothly curved toward an upper surface of said rack.

9. A steering system according to claim 1 wherein said at least one rigid cable guide is smoothly curved toward a lower surface of said rack.

* * * * *